United States Patent [19]

Edison

[11] Patent Number: 4,613,428

[45] Date of Patent: Sep. 23, 1986

[54] HYDROCARBON CRACKING PROCESS

[75] Inventor: Robert R. Edison, Olympia Fields, Ill.

[73] Assignee: Katalistiks, Inc.

[21] Appl. No.: 513,535

[22] Filed: Jul. 13, 1983

[51] Int. Cl.[4] ..... C10G 11/00

[52] U.S. Cl. ..... 208/113; 208/120; 423/244; 502/517

[58] Field of Search ..... 208/113, 120, 52 CE; 502/414, 517, 524; 423/244 R

[56] References Cited

U.S. PATENT DOCUMENTS

| | | | |
|---|---|---|---|
| 2,575,258 | 11/1951 | Corneil et al. | 208/47 |
| 4,146,463 | 3/1979 | Radford et al. | 208/120 |
| 4,268,416 | 5/1981 | Stine et al. | 208/52 CT |
| 4,285,806 | 8/1981 | Mooi | 208/113 |
| 4,298,459 | 11/1981 | Tatterson et al. | 208/113 |
| 4,316,794 | 2/1982 | Schoennagel | 208/108 |
| 4,325,811 | 9/1982 | Sorrentino | 208/113 |
| 4,345,992 | 8/1982 | Washer et al. | 208/153 |
| 4,377,470 | 3/1983 | Hettinger, Jr. et al. | 208/113 |
| 4,381,991 | 5/1983 | Bertolacini et al. | 423/244 R |
| 4,469,589 | 9/1984 | Yoo et al. | 208/120 |
| 4,541,922 | 9/1985 | Lomas et al. | 208/113 |

*Primary Examiner*—Andrew H. Metz
*Assistant Examiner*—Anthony McFarlane
*Attorney, Agent, or Firm*—Gary L. Wamer

[57] ABSTRACT

Disclosed is a hydrocarbon conversion process in which solid particles capable of promoting the conversion of a sulfur-containing hydrocarbon feedstock in intimate admixture with a minor amount of discrete entities effective to reduce atmospheric emissions of sulfur oxides from the process are circulated between at least one reaction zone wherein sulfur-containing deposits are formed on the solid particles, and at least one regeneration zone wherein at least a portion of the deposits is removed from the solid particles to produce regenerated solid particles which are circulated to the reaction zone and sulfur oxides; and the discrete entities are capable of associating with sulfur trioxide in the regeneration zone and of disassociating with sulfur trioxide in the reaction zone. The improvement comprises contacting the regenerated solid particles and discrete entities with at least one gaseous reducing medium prior to the solid particles and discrete entities entering the reaction zone.

43 Claims, No Drawings

HYDROCARBON CRACKING PROCESS

This invention relates to catalytic conversion of hydrocarbon feedstocks. More particularly, the present invention relates to an improved hydrocarbon conversion process for hydrocarbon feedstocks which improves the effectiveness of such process.

Various hydrocarbon conversion processes may be carried out using solid catalyst particles, e.g., in the fluidized state. The term "fluidized state" as used herein with respect to solid particles and/or discrete entities means that state in which such particles and/or entities flow substantially as a fluid would flow, i.e., from high pressure to low pressure. Thus, "to fluidize solid particles" is to cause such particles to flow substantially as a fluid.

In hydrocarbon processing, steam is often used to fluidize catalyst particles. However, contact with steam often tends to deactivate or otherwise detrimentally affect the catalyst particles.

Various gaseous media have been used to treat hydrocarbon conversion catalysts seeking to achieve specific results. See, for example, U.S. Pat. No. 4,325,811. Air has been used as a catalyst fluidizing medium, although this may present some hazards, in particular, as in hydrocarbon cracking where the reaction zone is maintained at about 800° F. or higher.

Typically, catalytic cracking of hydrocarbons takes place in a reaction zone at hydrocarbon cracking conditions to produce at least one hydrocarbon product and to cause carbonaceous material (coke) to be deposited on the catalyst. Additionally, some sulfur, originally present in the feed hydrocarbons may also be deposited, e.g., as a component of the coke, on the catalyst. It has been reported that approximately 50% of the feed sulfur is converted to $H_2S$ in the FCC reactor, 40% remains in the liquid products and about 4 to 10% is deposited on the catalyst. These amounts vary with the type of feed, rate of hydrocarbon recycle, steam stripping rate, the type of catalyst, reactor temperature, etc.

Sulfur-containing coke deposits tend to deactivate cracking catalyst. Cracking catalyst is advantageously continuously regenerated, by combustion with oxygen-containing gas in a regeneration zone, to low coke levels, typically below about 0.4% by weight, to perform satisfactorily when it is recycled to the reactor. In the regeneration zone, at least a portion of the sulfur, along with carbon and hydrogen, which is deposited on the catalyst, is oxidized and leaves in the form of sulfur oxides ($SO_2$ and $SO_3$, hereinafter referred to as "SOx") along with substantial amounts of CO, $CO_2$, and $H_2O$.

Considerable recent research effort has been directed to the reduction of sulfur oxide emissions from the regeneration zones of hydrocarbon catalytic cracking units. One technique involves circulating one or more metal-containing compounds capable of associating with oxides of sulfur with the cracking catalyst inventory in the regeneration zone. When the particles containing associated oxides of sulfur are circulated to the reducing atmosphere of the cracking zone, the associated sulfur compounds are released as gaseous sulfur-bearing material such as hydrogen sulfide which is discharged with the products from the cracking zone and are in a form which can be readily handled in a typical facility, e.g., petroleum refinery. The above-noted metal-containing component is regenerated to an active form, and is capable of further associating with the sulfur oxides when cycled to the regeneration zone.

One difficulty with this prior art process for reducing atmospheric sulfur oxide emissions is that certain metal-containing components readily associate with sulfur oxides in the catalyst regeneration zone but do not easily disassociate with the sulfur oxides in the reaction zone of such a process. This limitation reduces the overall effectiveness of the process as to reducing atmospheric sulfur oxide emissions. It would be advantageous to provide a process improvement wherein the disassociation of sulfur oxides from such metal-containing components is enhanced.

Therefore, one object of the present invention is to provide an improved hydrocarbon conversion process.

Another object of the present invention is to provide an improved process for catalytically converting a sulfur-containing, substantially hydrocarbon feedstock so that reduced atmospheric emissions of sulfur oxides are obtained. Other objects and advantages of the present invention will become apparent hereinafter.

An improved hydrocarbon conversion process has now been discovered. The present process involves hydrocarbon conversion, preferably hydrocarbon cracking, employing solid particles capable of promoting the conversion of a sulfur-containing hydrocarbon feedstock in intimate admixture with a minor amount of discrete entities effective to reduce atmospheric emissions of sulfur oxides from the process, preferably by at least about 50%, more preferably by at least 70%. The discrete entities typically comprise at least one metal-containing component capable of associating with at least one sulfur oxide, preferably sulfur trioxide, at the conditions present in the catalyst regeneration zone of the process and disassociating with such sulfur oxide at the conditions present in the reaction zone of the process. The present process comprises circulating the above-noted admixture between at least one reaction zone, wherein the feedstock is contacted with the solid particles and discrete entities at hydrocarbon conversion conditions to convert at least a portion of the feedstock to desired products and form sulfur-containing deposits, e.g., carbonaceous deposits, on the solid particles, and at least one regeneration zone, wherein at least a portion of the deposits on the solid particles are removed (e.g., by combustion with an oxygen-containing medium) to form regenerated solid particles and sulfur oxides.

The present improvement comprises contacting the regenerated solid particles and discrete entities with at least one gaseous reducing medium prior to the regenerated solid particles and discrete entities entering the reaction zone, thereby increasing the disassociation of sulfur oxides from the discrete entities. Substantially all of the reducing gaseous medium enters the reaction zone with the regenerated solid particles and discrete entities. The present improvement is particularly useful in situations wherein the temperature of the regenerated solid particles and discrete entities entering the regeneration zone is higher, preferably at least about 50° F. higher and more preferably at least about 150° F. higher, than the temperature (average) in the reaction zone.

Any gaseous reducing medium, or combination thereof, capable of enhancing the disassociation of sulfur oxides from the discrete entities may be used in the present invention. Preferably, the gaseous reducing medium is selected from the group consisting of hydrogen, hydrocarbons containing 1 to about 5 carbon atoms per molecule, carbon monoxide and mixtures thereof. More preferably, the gaseous reducing medium is selected from hydrocarbons containing 1 to about 5 carbon atoms per molecule and mixtures thereof. Hydrocarbons containing from 1 to about 5 carbon atoms per molecule include methane, ethane, ethylene, propane, propylene, butane, butylene, pentane and pentene. Still more preferably, at least a major portion by weight of the hydrocarbon is saturated. One particularly preferred gaseous reducing medium is fuel gas, e.g., conventionally produced as a by-product in petroleum refineries. Such fuel gas often comprises primarily methane and ethane, with a minor amount of ethylene and $C_{3-5}$ hydrocarbons.

The use of gaseous reducing medium, as described herein, has been found to result in substantial benefits. For example, reduced atmospheric emissions of sulfur oxides are obtained. In addition, where, as is preferred, the solid particles and discrete entities are present in the reaction zone (and more preferably also in the regeneration zone) in the fluidized state, improved particle fluidization and reduced catalyst deactivation are obtained. In addition, when a metals-containing hydrocarbon feedstock is being processed, the present gaseous reducing medium has been found to reduce the detrimental effects caused by the metal or metals deposited on the catalyst particles. This effect is particularly apparent in the event the metal or one of the metals in the feedstock is a vanadium component.

The preferred relative amounts of the solid particles and discrete entities are about 80 to about 99 parts and about 1 to about 20 parts by weight, respectively. This catalyst system is especially effective for the catalytic cracking of a hydrocarbon feedstock to lighter, lower boiling products.

The improvement of this invention can be used to advantage with the catalyst being disposed in any reactor-regenerator system which involves continuously conveying or circulating catalyst between reaction zone and regeneration zone and the like. Typical of the circulating catalyst bed systems are the conventional moving bed and fluidized bed reactor-regenerator systems. Both of these circulating bed systems are conventionally used in hydrocarbon conversion, e.g., hydrocarbon cracking operations, with the fluidized catalyst bed reactor-regenerator systems being preferred.

One preferred embodiment of the reaction zone-regeneration zone system useful in the present invention may be described as follows. The reaction zone may be a vessel into which fluidized solid particles and discrete entities and substantially hydrocarbon feedstock are introduced and in which hydrocarbon conversion takes place. In a more preferred embodiment, the reaction zone is configured so that the substantially hydrocarbon feedstock and solid particles and discrete entities flow substantially progressively through the reaction zone. The term "substantially progressive flow" as used herein refers to flow in substantially one direction with little or no substantial "back-mixing" in the reaction zone. Reaction zones which facilitate substantially progressive flow are preferably structured to provide the substantially hydrocarbon feedstock, solid particles and discrete entities with one or more elongated paths or routes through the reaction zone. One type of reaction zone which provides for such an elongated route is a "riser" reactor. Various commercially used hydrocarbon catalytic cracking units involve such riser reactors.

The hydrocarbon solid particles and discrete entities mixture from the reaction zone is separated, e.g., in one or more conventional cyclone separators, to form a hydrocarbon material which is sent to further conventional processing, e.g., fractional distillation and the like, and solid particles and discrete entities which are passed to the regeneration zone.

The regeneration zone is structured to facilitate contacting the solid particles with oxygen-containing gaseous medium, e.g., air, to remove sulfur-containing carbonaceous deposit material from the solid particles and produce regenerated solid particles and sulfur oxides. The structure and conditions of operation of the regeneration zone are not critical to the present invention. Such regeneration zones are widely used in hydrocarbon conversion, e.g., catalytic cracking, units and are conventional and well known in the art. Preferably, the regeneration zone operates at "total combustion".

The regenerated solid particles and discrete entities preferably flow from the regeneration zone to the reaction zone through at least one transfer line. In one preferred embodiment, the regenerated solid particles and discrete entities in the transfer line(s) are contacted with steam and/or a gaseous, non-reducing medium, preferably selected from the group consisting of nitrogen, carbon dioxide and mixtures thereof, to aid in fluidizing the regenerated particles and discrete entities. Alternately and more preferably, the regenerated catalyst particles in the transfer line(s) are contacted with a gaseous non-reducing medium selected from the group consisting of nitrogen, carbon dioxide and mixtures thereof, to aid in fluidizing the regenerated particles and discrete entities. The use of such more preferred gaseous non-reducing medium provides for improved fluidization (relative to steam) of the regenerated catalyst particles and discrete entities and, when used in conjunction with the gaseous reducing medium of the present invention, acts to prevent substantial amounts of oxygen from entering the reaction zone. In addition, the use of such more preferred gaseous non-reducing medium substantially avoids the catalyst deactivation apparent in the alternate embodiment using steam as an aid to fluidizing the regenerated particles and discrete entities.

The transfer line(s) between the regeneration zone and the reaction zone are preferably configured as follows when practicing the present invention. The transfer line preferably comprises at least one substantially vertical section and at least one substantially lateral (or horizontal) section. The regenerated particles and discrete entities are preferably contacted with the steam and/or gaseous non-reducing medium, as noted above, in the substantially vertical section, and are contacted with the gaseous reducing medium, as noted above, in the substantially lateral section. As used herein, the term "substantially vertical" refers to a section of transfer line structured to allow flow of particles in substantially the "up-down" direction. Preferably, such substantially vertical sections are oriented at an angle of about 30° or less from vertical. As used herein, the term "substantially lateral (or horizontal)" refers to a section of transfer line structured to allow flow of particles in substantially the "side to side" direction. Preferably, such substantially lateral (horizontal) sections are oriented at an angle of about 30° or less from the horizontal.

In one preferred configuration, the transfer line includes at least one valve assembly, e.g., a conventional slide valve, to control the rate of flow of the particles.

Such valve assembly is preferably located in a substantially vertical section of the transfer line with steam and/or gaseous non-reducing medium being used to contact the regenerated solid particles and discrete entities upstream (relative to the general direction flow of regenerated solid particles and discrete entities) of the valve assembly and gaseous reducing medium being used to contact the catalyst particles downstream of the valve means.

The quantities of steam, gaseous non-reducing medium and gaseous reducing medium employed are not critical to the present invention provided that the materials are present in sufficient quantities to perform the respective functions described herein. In addition, excessive amounts of these materials are to be avoided, for example, in order to minimize separation and reaction zone dilution problems.

The catalyst system used in accordance with the teachings of the invention is comprised of solid particles. The form, i.e., particle size, of the present solid particles and discrete entities is not critical to the present invention, provided that such particles and entities must be capable of being circulated between the reaction zone and the regeneration zone. Although the presently useful solid particles and discrete entities may be used as a physical admixture of separate particles, in one embodiment, the discrete entities are combined as part of the solid particles, i.e., as an integral part of at least a portion of the solid particles. That is, the discrete entities are combined with the solid particles, e.g., during the manufacture of the solid particles, to form combined particles which function as both the presently useful solid particles and discrete entities. In one preferred embodiment, in particular in a catalytic cracking embodiment, a major portion, more preferably at least about 80%, by weight of the separate solid particles and discrete entities, and the combined particles have diameters in the range of about 10 to about 250 microns, more preferably about 20 to about 125 microns.

The composition of the solid particles useful in the present invention is not critical, provided that such particles are capable of promoting the desired hydrocarbon conversion. Particles having widely varying compositions are conventionally used as catalysts in such hydrocarbon conversion processes, the particular composition chosen being dependent, for example, on the type of hydrocarbon chemical conversion desired. Thus, the solid particles suitable for use in the present invention include at least one of the natural or synthetic materials which are capable of promoting the desired hydrocarbon chemical conversion. For example, when the desired hydrocarbon conversion involves one or more of hydrocarbon cracking, disproportionation, isomerization, polymerization, alkylation and dealkylation, such suitable materials include acid-treated natural clays such as montmorillonite, keolin and bentonite clays; natural or synthetic amorphous materials, such as amorphous silica-alumina, silica-magnesia and silica-zirconia composites; synthetic crystalline aluminosilicates, often referred to as synthetic zeolites or synthetic molecular sieves and the like. In certain instances, e.g., hydrocarbon cracking and disproportionation, the solid catalyst particles preferably include such synthetic crystalline aluminosilicates to increase catalytic activity. Methods for preparing such solid catalyst particles are conventional and well known in the art. For example, crystalline aluminosilicate compositions can be made from alkali metal silicates and alkali metal aluminates so that they initially contain significant concentrations of sodium. Sodium tends to reduce the catalytic activity of the composition for hydrocarbon conversion reactions such as hydrocarbon cracking and disproportionation. Accordingly, most or all of the sodium in the synthetic crystalline aluminosilicate is removed or replaced, e.g., with other metal cations such as calcium or aluminum ions or ions of the rare earths. This can be accomplished by ion exchanging the crystalline aluminosilicate with soluble compounds of calcium, aluminum or the rare earths. It may also be desirable to substitute at least some of the sodium ions with hydrogen ions. This can be accomplished by contacting the synthetic crystalline aluminosilicate with a source of hydrogen ions such as acids, or hydrogen precursors such as ammonium compounds. These procedures are thoroughly described in U.S. Pat. No. 3,140,253 and U.S. Pat. No. Re. 27,639.

Compositions of the solid particles which are particularly useful in the present invention are those in which the synthetic crystalline aluminosilicate is incorporated in an amount effective to promote the desired hydrocarbon conversion, e.g., a catalytically effective amount, into a porous matrix which comprises, for example, amorphous material which may or may not be itself capable of promoting such hydrocarbon conversion. Included among such matrix material are clays and amorphous compositions of silica-alumina, magnesia, zirconia, mixtures of these and the like. The synthetic crystalline aluminosilicate is preferably incorporated into the matrix material in amounts within the range of about 1% to about 75%, more preferably about 2% to about 50%, by weight of the total catalyst particles. The preparation of synthetic crystalline aluminosilicate-amorphous matrix catalytic materials is described in the above-mentioned patents.

The discrete entities useful in the present invention comprise at least one metal-containing component capable of associating with at least one sulfur oxide, preferably sulfur trioxide, at the conditions present in the regeneration zone and of disassociating with such sulfur oxide at the conditions present in the reaction zone. The discrete entities preferably reduce the atmospheric emissions of surfur oxides from the present hydrocarbon conversion process by at least about 50%, more preferably by at least about 70%.

A large number of metal-containing components useful in the discrete entities are described in the prior art. These are all capable of benefit from utilization in accordance with the principles of this invention. In generally, these components are stable solids at the temperature of the FCC regenerator in that they do not melt, sublime, or decompose at such temperatures. The usable components are thermodynamically capable of associating with at least one sulfur oxide, preferably sulfur trioxide, upon renewed contact between the discrete entities and flue gas at the conditions of such contact, e.g., at the conditions present in the regeneration zone.

Among the metal-containing components are alumina, oxides of Group IIA metals, typified by magnesium set forth in U.S. Pat. Nos. 3,835,031 and 3,699,037; cerium oxides as described in U.S. Pat. No. 4,001,375; and the several metal components described in U.S. Pat. No. 4,153,534 including compounds of sodium, scandium, titanium, iron, chromium, molybdenum, manganese, cobalt, nickel, antimony, copper, zinc, cadmium, rare earth metals and lead. They are of varying effectiveness at different temperatures and will be applied to or mixed with the cracking catalyst as the conditions of a particular situation may indicate and applying the knowledge and skill of the art. Techniques for incorporating the desired metal-containing component will include impregnation with a salt of the desired metal, mulling the additive component with the cracking catalyst components, spray drying a slurry of mixed components and the like conventional procedures.

One preferred class of discrete entities for use in the present invention is that described in European Patent Convention Application No. 81303336.2, Publication No. 0045170. Such preferred discrete entities comprise an effective amount, preferably a major amount, of at least one metal-containing spinel, preferably alkaline earth metal-containing spinel.

The spinel structure is based on a cubic close-packed array of oxide ions. Typically, the crystallographic unit cell of the spinel structure contains 32 oxygen atoms; one-eighth of the tetrahedral holes (of which there are two per anion) are occupied by divalent metal ion, and one-half of the octahedral holes (of which there are two per anion) are occupied by trivalent metal ions.

This typical spinel structure or a modification thereof is adaptable to many other mixed metal oxides of the type $M^{II}M_2^{III}O_4$ (e.g., $FeCr_2O_4$, $ZnAl_2O_4$ and $Co^{II}Co_2^{III}O_4$), by some of the type $M^{IV}M^{II}O_4$ (e.g., $TiZn_2O_4$, and $SnCo_2O_4$), and by some of the type $M_2^{I}M^{VI}O_4$ (e.g., $Na_2MoO_4$ and $Ag_2MoO_4$). This structure is often symbolized as $X[Y_2]O_4$, where square brackets enclose the ions in the octahedral interstices. An important varient is the inverse spinel structure, $Y[XY]O_4$, in which half of the Y ions are in tetrahedral interstices and the X ions are in octahedral ones along with the other half of the Y ions. The inverse spinel structure is intended to be included within the scope of the term "metal-containing spinel" as used herein. The inverse spinel structure occurs often when the X ions have a stronger preference for octahedral coordination than do the Y ions. All $M^{IV}M_2^{II}O_4$ are inverse, e.g., $Zn(ZnTi)O_4$, and many of the $M^{II}M_2^{III}O_4$ ones are also, e.g., $Fe^{III}(Co^{II}Fe^{III})O_4$, $NiAl_2O_4Fe^{III}(Fe^{II}Fe^{III})O_4$ and $Fe(NiFe)O_4$. There are also many compounds with distorted spinel structures in which only a fraction of the X ions are in tetrahedral sites. This occurs when the preference of both X and Y ions for octahedral and tetrahedral sites do not differ markedly.

Further details on the spinel structure are described in the following references, which are hereby incorporated herein by reference: "Modern Aspects of Inorganic Chemistry" by H. I. Emeleus and A. G. Sharpe (1973), pp. 57–58 and 512–513; Structural Inorganic Chemistry", 3rd edition (1962) by A. F. Wells, pp. 130, 487–490, 503 and 526; and "Advanced Inorganic Chemistry", 3rd edition (1972), by F. A. Cotton and G. Wilkinson, pp. 54–55.

Metal-containing spinels include the following: $MnAl_2O_4$, $FeAl_2O_4$, $CoAl_2O_4$, $NiAl_2O_4$, $ZnAl_2O_4$, $MgTiMgO_4$, $FeMgFeO_4$, $FeTiFeO_4$, $ZnSnZnO_4$, $GaMgGaO_4$, $InMgInO_4$, $BeLi_2F_4$, $MoLi_2O_4$, $SnMg_2O_4$, $MgAl_2O_4$, $CuAl_2O_4$, $(LiAl_5O_8)$, $ZnK_2(CN)_4$, $CdK_2(CN)_4$, $HgK_2(CN)_4$, $ZnTi_2O_4$, $FeV_2O_4$, $MgCr_2O_4$, $MnCr_2O_4$, $FeCr_2O_4$, $CoCr_2O_4$, $NiCr_2O_4$, $ZnCr_2O_4$, $CdCr_2O_4$, $MnCr_2S_4$, $ZnCr_2S_4$, $CdCr_2S_4$, $TiMn_2O_4$, $MnFe_2O_4$, $FeFe_2O_4$, $CoFe_2O_4$, $NiFe_2O_4$, $CuFe_2O_4$, $ZnFe_2O_4$, $CdFe_2O_4$, $MgCo_2O_4$, $TiCo_2O_4$, $CoCo_2O_4$, $ZnCo_2O_4$, $SnCo_2O_4$, $CoCo_2S_4$, $CuCo_2S_4$, $GeNi_2O_4$, $NiNi_2S_4$, $ZnGa_2O_4$, $WAg_2O_4$, and $ZnSn_2O_4$.

The presently useful metal-containing spinels include a first metal and a second metal having a valence (oxidation state) higher than the valence of the first metal. The first and second metals may be the same metal or different metals. In other words, the same metal may exist in a given spinel in two or more different oxidation states. The atomic ratio of the first metal to the second metal in any given spinel neet not be consistent with the classical stoichiometric formula for such spinel.

The preferred metal-containing spinels for use in the present invention are alkaline earth metal spinels, in particular magnesium and aluminum-containing spinel. Lithium containing spinels, which may be produced using conventional techniques are also preferred for use. Other alkaline earth metal ions, such as calcium, stronium, barium and mixtures thereof, may replace all or a part of the magnesium ions. Similarly, other trivalent metal ions, such as iron, chromium, vanadium, manganese, gallium, boron, cobalt and mixtures thereof, may replace all or a part of the aluminum ions. When the spinel includes a divalent metal (e.g., magnesium) and a trivalent metal (e.g., aluminum), it is preferred that the atomic ratio of divalent to trivalent metals in the spinel be in the range of about 0.17 to about 1, more preferably about 0.25 to about 0.75, still more preferably about 0.35 to about 0.65 and still further more preferably about 0.45 to about 0.55.

The metal-containing spinels useful in the present invention may be derived from conventional and well known sources. For example, these spinels may be synthesized using techniques well known in the art. Thus, a detailed description of such techniques is not included herein. However, a brief description of the preparation of the most preferred spinel, i.e., magnesium aluminate spinel, is set forth below. Certain of the techniques described, e.g., drying and calcining, have applicability to other metal-containing spinels.

The magnesium aluminate spinel suitable for use in the present invention can be prepared, for example, according to the method disclosed in U.S. Pat. No. 2,992,191. The spinel can be formed by reacting, in an aqueous medium, a water-soluble magnesium inorganic salt and a water-soluble aluminum salt in which the aluminum is present in the anion. Suitable salts are exemplified by the strongly acidic magnesium salts such as the chloride, nitrate or sulfate and the water soluble alkali metal aluminates. The magnesium and aluminate slats are dissolved in an aqueous medium and a spinel precursor is precipitated through neutralization of the aluminate by the acidic magnesium salt. Excesses of acidic salt or aluminate are preferably not employed, thus avoiding the precipitation of excess magnesia or alumina. Preferably, the precipitate is washed free of extraneous ions before being further process.

The precipitate can be dried and calcined to yield the magnesium aluminate spinel. Drying and calcination may take place simultaneously. However, it is preferred that the drying take place at a temperature below which water of hydration is removed from the spinel precursor. Thus, this drying may occur at temperatures below about 500° F., preferably from about 220° F. to about 450° F. Suitable calcination temperatures are exemplified by temperatures ranging from about 800° F. to about 2000° F. or more. Calcination of the spinel precursor may take place in a period of time of at least about one half hour and preferably in a period of time ranging from about 1 hour to about 10 hours.

Another process for producing the presently useful magnesium aluminate spinel is set forth in U.S. Pat. No. 3,791,992. This process includes mixing a solution of a soluble acid salt of divalent magnesium with a solution of an alkali metal aluminate; separating washing the resulting precipitate; exchanging the washed precipitate with a solution of an ammonium compound to decrease the alkali metal content; followed by washing, drying, forming and calcination steps. The disclosure of U.S. Pat. No. 3,791,992 is hereby incorporated herein by reference. In general, as indicated previously, the metal-containing spinels useful in the present invention may be prepared by methods which are conventional and well known in the art.

The present discrete entities may be formed into particles of any desired shape such as pills, cake, extrudates, powders, granules, spheres, and the like using conventional methods. The size selected for the particles can be dependent upon the intended environment in which the final discrete entities are to be used—as, for example, whether as a separate particle or as part of a mass of combined particles.

In one preferred embodiment, the presently useful discrete entities also contain at least one additional metal component. These additional metal components are defined as being capable of promoting the oxidation of sulfur dioxide to sulfur trioxide at combustion conditions, e.g., the conditions present in the catalyst regenerator. Increased carbon monoxide oxidation may also be obtained by including at least one of the additional metal components. Such metal components are selected from the group consisting of Group IB, IIB, IVB, VIA, VIB, VIIA, and VIII of the Periodic Table, the rare earth metals, vanadium, iron, tin and antimony and mixtures thereof and may be incorporated into the presently useful discrete entities, in any suitable manner. Many techniques for including the additional metal in the particulate material are conventional and well known in the art. The additional metal, e.g., platinum group metal, such as platinum, may exist within the particulate material, e.g., discrete entities, at least in part as a compound such as an oxide, sulfide, halide and the like, or in the elemental state. Generally, the amount of the platinum group metal component present in the final discrete entities is small. The platinum group metal component preferably comprises from about 0.05 parts-per-million (ppm) to about 1%, more preferably about 0.05 ppm. to about 1000 ppm., and still more preferably about 0.5 ppm. to about 500 ppm., by weight of the discrete entities, calculated on an elemental basis. The other additional metals may be included in the particulate material in an amount effective to promote the oxidation of at least a portion, preferably a major portion, of the sulfur dioxide present to sulfur trioxide at the conditions of combustion, e.g., conditions present in the catalyst regeneration zone of a hydrocarbon catalytic cracking unit. Preferably, the present discrete entities comprise a minor amount by weight of at least one additional metal component (calculated as elemental metal). Of course, the amount of additional metal used will depend, for example, on the degree of sulfur dioxide oxidation desired and the effectiveness of the additional metal component to promote such oxidation.

In one particularly preferred embodiment, the additional metal component comprises at least one rare earth metal component, preferably cerium component.

Cerium or other suitable rare earth or rare earth mixture may be associated with the discrete entities using any suitable technique or combination of techniques; for example, impregnation, coprecipitation, ion-exchange and the like, well known in the art, with impregnation being preferred. Impregnation may be carried out by contacting the discrete entities with a solution, preferably aqueous, of rare earth; for example, a solution containing cerium ions (preferably $Ce^{+3}$, $Ce^{+4}$ or mixtures thereof) or a mixture of rare earth cations containing a substantial amount (for example, at least 40%) of cerium ions. Water-soluble sources of rare earth include the nitrate and chloride. Solutions having a concentration of rare earth in the range of 3 to 30% by weight are preferred. Preferably, sufficient rare earth salt is added to incorporate about 0.05 to 25% (weight), more preferably about 0.1 to 15% rare earth, and still more preferably about 1.0 to 15% rare earth, by weight, calculated as elemental metal, on the discrete entities.

Alternately to inclusion in the discrete entities, one or more additional metal components may be present in all or a portion of the above-noted solid particles and/or may be included in a type or particle other than either the present solid particles or discrete entities. For example, separate particles comprising at least one additional metal component and porous inorganic oxide support, e.g., platinum on silica, may be included along with the solid particle and discrete entities to promote sulfur dioxide oxidation.

The presently useful discrete entities preferably have a surface area in the range of about 25 $m^2$/gm. to about 600 $m^2$/gm., more preferably about 50 $m^2$/gm. to about 400 $m^2$/gm., and still more preferably about 75 $m^2$/gm. to about 350 $m^2$/gm.

The additional metal component may be associated with the discrete entities in any suitable manner such as those which are conventional and well known in the art.

Although this invention is useful in many hydrocarbon chemical conversions, the present process finds particular applicability in systems for the catalytic cracking of hydrocarbons and the regeneration of solid catalyst particles so employed. Such catalytic hydrocarbon cracking often involves converting, i.e., cracking, heavier or higher boiling hydrocarbons to gasoline and other lower boiling components, such as hexane, hexene, pentane, pentene, butane, butylene, propane, propylene, ethane, ethylene, methane and mixtures thereof. The amount of sulfur in the presently useful sulfur-containing hydrocarbon feedstock may vary over a broad range and is preferably in the range of about 0.01 to about 5%, more preferably about 0.2% to about 5% by weight of the total feedstock. In one embodiment, the sulfur-containing, substantially hydrocarbon feedstock comprises a gas oil fraction and/or other fraction typically used as feedstock in hydrocarbon catalytic cracking, e.g., derived from petroleum, shale oil, tar sand oil, coal and the like. Such feedstock may comprise a mixture of straight run, e.g., virgin gas oil. Such gas oil fractions often boil primarily in the range of about 400° F. to about 1000° F. Other substantially hydrocarbon feedstocks, e.g., other high boiling or heavy fractions of petroleum, shale oil, tar sand oil, coal and the like, may be cracked using the process of the present invention. In one preferred embodiment, at least a portion of, more preferably at least a major portion of, the substantially hydrocarbon feedstock comprises a petroleum derived residuum. Such residuum may be defined as that material which has not been taken overhead (or distilled) in any of the fractional distillations to which a given petroleum crude oil may be subjected. Thus, by its very nature, a petroleum residuum often contains a significant portion of the total metals present in the original petroleum crude oil. Each of the above-noted substantially hydrocarbon feedstock often contain minor amounts of other contaminants, e.g., nitrogen, metal contaminants (e.g., iron, nickel, vanadium and copper) and the like.

Hydrocarbon cracking conditions are well known and often include temperatures in the range of about 850° F. to about 1100° F., preferably about 900° F. to about 1050° F. Other reaction conditions usually include pressures of up to about 100 psig.; solid particle to oil weight ratios of about 1 to 5 to about 25 to 1; and weight hourly space velocities (WHSV) of 3 to about 60. These hydrocarbon cracking conditions are not critical to the present invention and may be varied depending, for example, on the feedstock and solid particles and discrete entities being used and the product or products wanted.

In addition, the catalytic hydrocarbon cracking system includes a regeneration zone for restoring the catalytic activity of the solid particles previously used to promote hydrocarbon cracking. Sulfur carbonaceous deposit-containing solid particles from the reaction zone are contacted with free oxygen-containing gas in the regeneration zone at conditions to restore or maintain the catalytic activity of the solid particles by removing, i.e., combusting, at least a portion of the sulfur carbonaceous material from the solid particles. The conditions at which such contacting takes place are not critical to the present invention. The temperature in the catalyst regeneration zone of a hydrocarbon cracking system is often in the range of about 900° F. to about 1500° F., preferably about 1000° F. to about 1450° F. and more preferably about 1100° F. to about 1400° F. Other conditions within such regeneration zone include, for example, pressures up to about 100 psig., and average solid particle contact times within the range of about 3 mintues to about 120 minutes, preferably from about 3 minutes to about 75 minutes. Sufficient oxygen is preferably present in the regeneration zone to completely combust the carbonaceous deposit material, for example, to sulfur trioxide, carbon dioxide and water. The amount of sulfur carbonaceous material deposited on the catalyst in the reaction zone is preferably in the range of about 0.005% to about 15%, more preferably about 0.1% to about 10%, by weight of the solid particles. At least a portion of the regenerated catalyst is returned to the hydrocarbon cracking reaction zone, as noted previously.

In a further embodiment, the present process is applicable in a "pre-treat" mode. That is, the present process is useful where the contacting (in the present reaction zone) of a sulfur-containing hydrocarbon feedstock, e.g., a petroleum derived residuum, with solid particles and discrete entities is primarily directed to conditioning a portion of the feedstock for further processing, e.g., catalytic cracking. For example, see U.S. Pat. No. 4,263,128 and related patents. Although, in this embodiment, the primary purpose of these solid particles or contact particles is to provide a place where undesirable material, e.g., sulfur, metals and heavy hydrocarbon components, may be deposited during the above-noted contacting, at least at minimal amount of conversion of the feedstock takes place. Therefore, by definition, the solid particles useful in the present invention include such contact particles which have only a minimal capability of promoting hydrocarbon conversion, as described in U.S. Pat. No. 4,263,128, the specification of which is hereby incorporated herein by reference.

In this "pre-treating" embodiment, the contact particles, discrete entities and sulfur-containing hydrocarbon feedstock are preferably contacted in a contactor (reaction zone) very similar in construction and operation to the riser reactors employed in modern fluid catalytic cracking units. Typically, a feedstock comprising petroleum residuum, is introduced to one end of a vertical conduit. Volatile material, such as light hydrocarbons and/or steam in amounts to substantially decrease hydrocarbon partial pressure is preferably added with the feedstock.

At the other end of the riser, the contact particles and discrete entities are rapidly separated from oil vapors. During the course of this contacting, sulfur and metal-containing heavy components of high Conradson Carbon value deposits on the contact particles.

The contact particles, now bearing such deposits are then contacted (in at least one regeneration zone) with an oxygen-containing gaseous medium, e.g., air, for example, by any of the techniques suited to regeneration of cracking catalyst, to combust at least a portion of the deposit material and form sulfur oxide. Combustion of the deposit material from the contact particles generates at least a portion of the heat used in the contacting step (reaction zone) when the contact particles and discrete entities are returned to the riser.

Such contact particles may be of any material capable of withstanding the conditions of the process and performing the functions outlined above. One preferred contact particle comprises calcined kaolin clay preferably in the form of microspheres.

The conditions existing in the reaction zone and regeneration zone of the "pre-treat" embodiment are preferably substantially similar to the corresponding conditions as indicated above for the hydrocarbon cracking embodiment of the present invention. More preferably, the conditions in the reaction zone are such as to substantially eliminate the thermal cracking of the hydrocarbon feedstock.

The following examples clearly illustrate the present invention. However, these examples are not to be interpreted as specific limitations on the invention.

EXAMPLE I

A mass of commercially available hydrocarbon cracking catalyst containing silica-alumina and synthetic crystalline aluminosilicate is used to crack a conventional petroleum derived gas oil stream, to lower boiling hydrocarbons in a conventional fluid catalytic cracking unit (FCCU). Substantially all, by weight, of the catalyst particles have diameters in the range of about 20 microns to about 125 microns.

A separate mass of cerium-containing, magnesium and aluminum spinel particles is prepared using conventional techniques. The final spinel particles have a surface area of about 180 $m^2$/gm., contain a major amount of magnesium aluminate spinel and about 10% by weight of cerium oxide, calculated as elemental cerium. Substantially all, by weight, of the spinel-containing particles have diameters in the range of about 20 microns to about 125 microns. This separate mass of spinel particles is mixed with the cracking catalyst noted above and fed to the FCCU. The spinel particles equal about 5% by weight of the total catalyst-spinel particles present in the FCCU.

The gas oil which is employed includes about 1.5% by weight of sulfur and about 5 to about 30 ppm. (by weight) each of vanadium, iron and nickel.

Briefly, such FCCU involves a reaction zone and a regeneration zone in at least limited fluid communication with each other. Substantially hydrocarbon feedstock and catalyst particles are fed to the reaction zone at hydrocarbon cracking conditions. The reaction zone is configured as an elongated riser to facilitate substantially progressive flow of the feedstock and catalyst particles. At least a portion of the hydrocarbon cracking occurs in this reaction zone, where the catalyst, spinel particles and hydrocarbon form a fluid phase.

Catalyst and hydrocarbon are continuously drawn from the reaction zone. The hydrocarbon is sent for further processing, e.g., distillation and the like. A portion of the hydrocarbon product is is recycled to the reaction zone. Catalyst, stripped of hydrocarbon, flows to the catalyst regeneration zone where it is combined with air at proper conditions to combust at least a portion of the sulfur-containing carbonaceous deposits from the catalyst formed during the hydrocarbon cracking reaction. The catalyst, spinel particles and vapors in the regeneration zone form a fluid phase. A mixture of catalyst and spinel particles is continuously removed from the regeneration zone, by way of a catalyst transfer line, and is combined with the hydrocarbon feedstock prior to being fed to the reaction zone. Sulfur oxides form in the regeneration zone and associate with the spinel particles.

The catalyst transfer line includes a substantially vertical section extending directly from the regeneration zone and a substantially lateral section downstream (relative to the general direction of flow of regenerated catalyst particles) of the substantially vertical section. A conventional slide valve is placed in the substantially vertical section to control the flow of catalyst and spinel particles in the transfer line. Steam is injected into the transfer line upstream of the slide valve to aid in fluidizing the regenerated catalyst and spinel particles. Fuel gas, a reducing medium comprising a major amount by weight of methane and minor amounts of $C_5$ and lower hydrocarbons, is used in the lateral section of the transfer line to fluidize the regenerated catalyst and spinel particles prior to such particles entering the reaction zone. Substantially all of the fuel gas employed enters the reaction zone with the regenerated catalyst and spinel particles.

The weight ratio of catalyst and spinel particles to total (fresh plus recycle) substantially hydrocarbon feed entering the reaction zone is about 8 to 1. Other conditions within the reaction zone include:

Temperature, °F.: 930
Pressure, psig.: 8
WHSV: 15

Such conditions result is about 70% by volume conversion of the gas oil feedstock to products boiling at 400° F. and below.

The catalyst particles from the reaction zone include about 1.5% by weight of sulfur carbonaceous deposit material which is at least partially combusted in the regeneration zone. Air, in an amount so that the amount of oxygen in the regeneration zone is about 1.15 times the amount theoretically required to completely combust this deposit material, is admitted to the regeneration zone. Conditions within the regeneration zone include:

Temperature, °F.: 1150
Pressure, psig.: 8
Average Catalyst Residence Time, min.: 12

The regenerated catalyst particles do accumulate a certain amount of metal, e.g., vanadium, iron and nickel, component. The regenerated catalyst and spinel particles leave the regeneration zone at about 1150° F.

After a period of time, the operation described above provides satisfactory results. That is, the fuel gas satisfactorily fluidizes the regenerated catalyst particles and the hydrocarbon cracking reaction(s) provide satisfactory yields of hydrocarbon products. In addition the use of fuel gas in the lateral section of the catalyst tranfer line results in improved catalyst effectiveness, for example, in reducing sulfur oxide atmospheric emissions.

EXAMPLE II

Example I is repeated except that air is used instead of steam in the substantially vertical section of the catalyst transfer line.

As in Example I, after a period of time, the operation described above provides satisfactory results. In addition, the use of air in the substantially vertical section of the transfer line improves the effectiveness of the catalyst particles, e.g., relative to the use of steam.

EXAMPLES III AND IV

Examples I and II are repeated except that the hydrocarbon feedstock being cracked contains 80% by weight of the gas oil stream, as previously described, and 20% by weight of a conventionally derived petroleum residuum from atmospheric distillation (700° F.+). This residuum includes about 3% by weight of sulfur, about 20 to about 70 ppm. (by weight) each of vanadium, iron and nickel, and about 10% by weight of Conradson Carbon Residue.

As in Examples I and II, after a period of time each of the operations described above provides satisfactory results.

EXAMPLES V AND VI

Examples I and II are repeated except that the hydrocarbon feedstock is the conventionally derived petroleum residuum described in Examples III and IV.

As in Examples I and II, after a period of time each of the operations described above provides satisfactory results.

EXAMPLE VII

This Example illustrates the present process in the "pre-treat" mode.

A mass of particles is provided comprising separate particles of the cerium-containing magnesium and aluminum spinel particles as described in Example I and calcined microspheres of kaolin clay. The kaolin clay microspheres have diameters in the range of about 20 microns to about 125 microns and have a surface area of about 15 $m^2/gm$. The separate spinel particles and the calcined kaolin clay microspheres are combined so that the spinel particles equal about 5% by weight of the total microspheres-spinel particles in the mass.

This mass of particles and the residuum described in Example III are fed to a reactor-regenerator system substantially similar to the FCCU described in Example I. In addition, steam is added to the reaction zone of this system to reduce the partial pressure of the hydrocarbons. The conditions of temperature, pressure, hydrocarbon space velocity, oxygen concentration, average catalyst residence time in the reaction zone and regeneration zone of this system are similar to those conditions as set forth in Example I Fuel gas is added to the catalyst transfer line between the regeneration zone and the reaction zone, are described in Example I.

Over a period of time the amount of sulfur oxides emitted from this system is reduced relative to an operation in which no fuel gas is fed to the catalyst transfer line between the regeneration zone and the reaction zone. In addition, the hydrocarbon product from the reaction zone has reduced concentration of metals and Conradson Carbon residue relative to the original petroleum residuum feedstock. This conditioned (or converted) feedstock is better suited, relative to the original residuum feedstock, for further processing, e.g., hydrocarbon catalytic cracking.

While this invention has been described with respect to various specific examples and embodiments, it is to be understood that the invention is not limited thereto and that it can be various practiced within the scope of the following claims:

The embodiments of this invention in which an exclusive property or privilege is claimed are defined as follows:

1. In a hydrocarbon cracking process in which solid particles capable of promoting the cracking of a sulfur-containing hydrocarbon feedstock in intimate admixture with a minor amount of discrete entities effective to reduce atmospheric emissions of sulfur oxides from said process and having a composition different than said solid particles are circulated between at least one reaction zone wherein said feedstock is contacted with said solid particles and discrete entities at hydrocarbon cracking conditions to convert at least a portion of said feedstock and form sulfur-containing deposits on said solid particles, and at least one regeneration zone wherein at least a portion of said deposits is removed from said solid particles to produce regenerated solid particles which are circulated to said reaction zone and sulfur oxides; said discrete entities comprising at least one metal-containing component capable of associating with at least one sulfur oxide at the conditions present in said regeneration zone and of disassociating with said sulfur oxide at the conditions present in said reaction zone; the improvement comprising contacting said regenerated solid particles and discrete entities with at least one gaseous reducing medium prior to said solid particles and discrete entities entering said reaction zone thereby increasing the disassociation of said sulfur oxides from said discrete entities, provided that said solid particles and said discrete entities are present in separate particles and substantially all of said gaseous reducing medium entering said reaction zone with said regenerated solid particles and discrete entities.

2. The process of claim 1 wherein a major portion by weight of said solid particles have diameters in the range of about 10 microns to about 250 microns.

3. The process of claim 1 wherein said discrete entities are effective to reduce atmospheric emissions of sulfur oxides from said process by at least about 50%.

4. The process of claim 2 wherein said discrete entities are effective to reduce atmospheric emissions of sulfur oxides from said process by at least about 50%.

5. The process of claim 1 wherein said discrete entities comprise at least one additional metal component capable of oxidizing $SO_2$ to $SO_3$ at the conditions present in said regeneration zone.

6. The process of claim 1 wherein said feedstock and said solid particles and discrete entities flow substantially in one direction through said reaction zone.

7. The process of claim 5 wherein said additional metal component is associated with at least one inorganic oxide.

8. The process of claim 1 wherein said discrete entities are effective to reduce atmospheric emissions of sulfur oxides from said process by at least about 70%.

9. The process of claim 1 wherein said discrete entities comprise magnesium-aluminum spinel-containing composition having a surface area in the range of about 25 $m^2$/gm. to about 600 $m^2$/gm.

10. The process of claim 9 wherein said discrete entities further comprise at least one additional metal component capable of promoting the oxidation of $SO_2$ to $SO_3$ at the conditions present in said regeneration zone.

11. The process of claim 1 wherein said solid particles and discrete entities are present in said reaction zone in the fluidized state and said regenerated solid particles and discrete entities flow from said regeneration zone to said reaction zone through at least one transfer line and said regenerated solid particles are contacted with at least one of steam or a gaseous non-reducing medium selected from the group consisting of air, nitrogen, carbon dioxide and mixtures thereof in said transfer line to aid in fluidizing said regenerated solid particles and discrete entities.

12. The process of claim 9 wherein said discrete entities are effective to reduce atmospheric emissions of sulfur oxides from said process by at least about 50%.

13. The process of claim 10 wherein said discrete entities are effective to reduce atmospheric emissions of sulfur oxides from said process by at least about 70%.

14. The process of claim 10 wherein said solid particles and discrete entities are present in said reaction zone in the fluidized state and said regenerated solid particles and discrete entities flow from said regeneration zone to said reaction zone through at least one transfer line and said regenerated solid particles are contacted with at least one of steam or a gaseous non-reducing medium selected from the group consisting of air, nitrogen, carbon dioxide and mixtures thereof in said transfer line to aid in fluidizing said regenerated solid particles and discrete entities.

15. The process of claim 1 wherein said gaseous reducing medium is selected from the group consisting of hydrogen, hydrocarbons containing 1 to about 5 carbon atoms per molecule carbon monoxide and mixtures thereof.

16. The process of claim 2 wherein said gaseous reducing medium is selected from the group consisting of hydrogen, hydrocarbons containing 1 to about 5 carbon atoms per molecule carbon monoxide and mixtures thereof.

17. The process of claim 2 wherein said gaseous reducing medium is selected from the group consisting of hydrogen, hydrocarbons containing 1 to about 5 carbon atoms per molecule carbon monoxide and mixtures thereof.

18. The process of claim 5 wherein said gaseous reducing medium is selected from the group consisting of hydrogen, hydrocarbons containing 1 to about 5 carbon atoms per molecule carbon monoxide and mixtures thereof.

19. The process of claim 9 wherein said gaseous reducing medium is selected from the group consisting of hydrogen, hydrocarbons containing 1 to about 5 carbon atoms per molecule carbon monoxide and mixtures thereof.

20. The process of claim 10 wherein said gaseous reducing medium is selected from the group consisting of hydrogen, hydrocarbons containing 1 to about 5 carbon atoms per molecule carbon monoxide and mixtures thereof.

21. The process of claim 1 wherein said gaseous reducing medium is selected from hydrocarbons containing 1 to about 5 carbon atoms per molecule and mixtures thereof.

22. The process of claim 2 wherein said gaseous reducing medium is selected from hydrocarbons containing 1 to about 5 carbon atoms per molecule and mixtures thereof.

23. The process of claim 2 wherein said gaseous reducing medium is selected from hydrocarbons containing 1 to about 5 carbon atoms per molecule and mixtures thereof.

24. The process of claim 5 wherein said gaseous reducing medium is selected from hydrocarbons containing 1 to about 5 carbon atoms per molecule and mixtures thereof.

25. The process of claim 9 wherein said gaseous reducing medium is selected from hydrocarbons containing 1 to about 5 carbon atoms per molecule and mixtures thereof.

26. The process of claim 10 wherein said gaseous reducing medium is selected from hydrocarbons containing 1 to about 5 carbon atoms per molecule and mixtures thereof.

27. The process of claim 7 wherein said additional metal component comprises a rare earth metal component.

28. The process of claim 10 wherein said additional metal component comprises at least one cerium component.

29. In a hydrocarbon cracking process in which solid particles capable of promoting the cracking of a sulfur-containing hydrocarbon feedstock in intimate admixture with a minor amount of discrete entities effective to reduce atmospheric emissions of sulfur oxides from said process and having a composition different than said solid particles are circulated between at least one reaction zone wherein said feedstock is contacted with said solid particles and discrete entities at hydrocarbon cracking conditions to convert at least a portion of said feedstock and form sulfur-containing deposits on said solid particles, and at least one regeneration zone wherein at least a portion of said deposits is removed from said solid particles to produce regenerated solid particles which are circulated to said reaction zone and sulfur oxides; said discrete entities comprising at least one metal-containing component capable of associating with at least one sulfure oxide at the conditions present in said regeneration zone and of disassociating with said sulfur oxide at the conditions present in said reaction zone; the improvement comprising contacting said regenerated solid particles and discrete entities with at least one gaseous reducing medium prior to said solid particles and discrete entities entering said reaction zone thereby increasing the disassociation of said sulfur oxides from said discrete entities, provided that said solid particles and said discrete entities are present in combined particles, said discrete entities comprise at least one rare earth metal component capable of promoting the oxidation of $SO_2$ to $SO_3$ at the conditions present in said regeneration zone and substantially all of said gaseous reducing medium entering said reaction zone with said regenerated solid particles and discrete entities.

30. The process of claim 29 wherein a major portion by weight of said solid particles have diameters in the range of about 10 microns to about 250 microns.

31. The process of claim 29 wherein a major portion by weight of said solid particles have diameters in the range of about 10 microns to about 250 microns.

32. The process of claim 29 wherein said discrete entities are effective to reduce atmospheric emissions of sulfur oxides from said process by at least about 50%.

33. The process of claim 29 wherein said feedstock and said solid particles and discrete entities flow substantially in one direction through said reaction zone.

34. The process of claim 29 wherein said rare earth metal component is associated with at least one inorganic oxide.

35. The process of claim 29 wherein said discrete entities comprise magnesium-aluminum spinel-containing composition having a surface area in the range of about 25 $m^2$/gm. to about 600 $m^2$/gm.

36. The process of claim 35 wherein said solid particles and discrete entities are present in said reaction zone in the fluidized state and said regenerated solid particles and discrete entities flow from said regeneration zone to said reaction zone through at least one transfer line and said regenerated solid particles are contacted with at least one of steam or a gaseous non-reducing medium selected from the group consisting of air, nitrogen, carbon dioxide and mixtures thereof in said transfer line to aid in fluidizing said regenerated solid particles and discrete entities.

37. The process of claim 35 wherein said discrete entities are effective to reduce atmospheric emissions of sulfur oxides from said process by at least about 50%.

38. The process of claim 29 wherein said gaseous reducing medium is selected from the group consisting of hydrogen, hydrocarbons containing 1 to about 5 carbon atoms per molecule carbon monoxide and mixtures thereof.

39. The process of claim 35 wherein said gaseous reducing medium is selected from the group consisting of hydrogen, hydrocarbons containing 1 to about 5 carbon atoms per molecule carbon monoxide and mixtures thereof.

40. The process of claim 29 wherein said gaseous reducing medium is selected from hydrocarbons containing 1 to about 5 carbon atoms per molecule and mixtures thereof.

41. The process of claim 35 wherein said gaseous reducing medium is selected from hydrocarbons containing 1 to about 5 carbon atoms per molecule and mixtures thereof.

42. The process of claim 29 wherein said rare earth metal component comprises cerium.

43. The process of claim 35 wherein said rare earth metal component comprises cerium.

* * * * *